United States Patent [19]

Ziegelmuller

[11] Patent Number: 5,040,030

[45] Date of Patent: Aug. 13, 1991

[54] PRECISE LOADING BLADE AND METHOD FOR MAKING SAME

[75] Inventor: Francisco L. Ziegelmuller, Penfield, N.Y.

[73] Assignee: Eastman Kodak Company, Rochester, N.Y.

[21] Appl. No.: 634,263

[22] Filed: Dec. 14, 1990

[51] Int. Cl.[5] ..... G03G 21/00

[52] U.S. Cl. ..... 355/299; 15/256.51; 118/652; 430/125

[58] Field of Search ..... 355/299, 296, 297, 298; 118/652; 430/125; 15/1.51, 256.51

[56] References Cited

U.S. PATENT DOCUMENTS

| | | | |
|---|---|---|---|
| 4,498,760 | 2/1985 | Sugiyama | 15/256.51 X |
| 4,639,123 | 1/1987 | Adachi et al. | 118/652 X |
| 4,789,432 | 12/1988 | Goodnow et al. | 162/281 |
| 4,803,752 | 2/1989 | Kasama | 15/256.51 X |
| 4,970,560 | 11/1999 | Lindblad et al. | 355/299 |
| 4,978,999 | 12/1990 | Frankel et al. | 355/299 |

*Primary Examiner*—A. T. Grimley
*Assistant Examiner*—Thu Dang
*Attorney, Agent, or Firm*—Tallam I. Nguti

[57] ABSTRACT

A cleaning blade for precise loading and sealing against an electrostatographic surface to be cleaned has a stiffness per unit length value within the range of 0.5 lb./in.$^2$, and a thickness T tolerance of ±4% T.

7 Claims, 2 Drawing Sheets

PRECISE LOADING BLADE AND METHOD FOR MAKING SAME

BACKGROUND OF THE INVENTION

1. Technical Field

This invention relates to electrostatographic cleaning apparatus and, more particularly, to a cleaning blade for use in such apparatus, and to a method for making such a blade. The blades described herein are adapted to load and seal against the surface being cleaned in a substantially precise manner despite spatial variabilities in the mounting of the blade, the straightness of the cleaning edge, or that of the surface being cleaned.

2. Background Art

Electrostatographic process apparatus which, for example, produce or reproduce toned images on selected substrates by employing electrostatic charges and toner particles on an insulated photoconductive surface, typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with particles of toner, (4) transferring the toned image to a suitable substrate for fusing thereon to form a permanent record, and (5) cleaning by removing residual toner and/or other particles from the photoconductive surface in preparation for similarly producing another image.

The quality of the images produced by such apparatus depends significantly on the ability to clean the photoconductive surface before it is reused. Several types of cleaning mechanisms, including blade-type cleaners as disclosed, for example, in U.S. Pat. No. 4,789,432, issued Dec. 6, 1988 in the name Goodnow et al. Typically, such a cleaning blade device has a sharp edge at one end for cleaning, and is supported by suitable means as a cantilevered member at its other end. The length of the cleaning edge, and hence of the first end, is determined ordinarily by the width of the surface to be cleaned.

In electrostatographic apparatus such as a copier or printer including an image-bearing surface, the range of a loading force per unit length that can be applied for loading the cleaning edge of such a blade against the image-bearing surface is limited, for example to 0.1 to 0.2 lb./in. in order not to damage such image-bearing surface being cleaned. Conventionally, therefore (given a load force per unit length value within such a limited range), the material for the cantilevered or free extension width of the blade, as well as its thickness, are then selected and formed so as to achieve a desired deflection or particular load value of the blade against the surface being cleaned. Another conventional way or method for making a cleaning blade is by trial and error of various blades of varying thicknesses and widths until one is formed that is believed will work. It is then selected and loaded against the surface being cleaned such that it has a desired load force per unit length of its cleaning edge, as well as a desired deflection thereof relative to the surface. The desired force load per unit length must be high enough in order to result in an effective sealing of the cleaning edge against such surface, but not so high as to damage such surface. Precision of the actual force loading and actual sealing achieved relative to such desired values is, therefore, important.

Unfortunately, however, it has been found that for a conventional trial and error selected blade that is loaded so as to have, for example, a 0.1 lb./in. load force per unit length, the actual load force per unit length experienced across the length of the cleaning edge can vary substantially, for example by as much as 60%. This can be due, for example, to a spatial variability of as little as 0.003 of an inch in the straightness of the cleaning edge, in that of the surface being cleaned, and/or in runout or eccentricity of the surface being cleaned. Such a substantial variation of the actual loading force per unit length across the length of the cleaning edge can undesirably result in ineffective sealing and cleaning at the low end, and in significant damage to the image-bearing surface at the high end.

SUMMARY OF THE INVENTION

It is an object of the present invention to provide an effective cleaning blade that loads and seals against a surface being cleaned in a substantially precise manner despite variabilities, for example, in the straightness of the cleaning edge or in that of the surface being cleaned.

It is another object of the present invention to provide a cleaning blade and method of making same that, when mounted to have a predetermined nominal load force per unit length against the surface being cleaned, exhibits a load force per unit length variability of less than $\pm 12\%$ of nominal across the length of its cleaning edge.

It is also an object of the present invention to provide a cleaning blade, for cleaning an image-bearing surface, that is less likely to overload and damage such surface.

In accordance with the present invention, a cleaning blade is provided that loads and seals in a substantially precise manner against a surface being cleaned. The blade, which may be generally rectangular, is made of a resilient material that has a Young's modulus E. The blade, which has a first end and an opposite second end, has a sharp cleaning edge at such first end, a length L inches, and a thickness T inches. The blade also has a mounting line located between the first and second ends at which the blade can be mounted in a cantilevered manner. The width of the blade from the first end thereof extending to the mounting line is W inches, and is such that the stiffness per unit length value of the blade is $(E/4)(T/W)^3$, and is within the range of 0.5 lb./in.$^2$ to 2.5 lb./in.$^2$.

In accordance with another aspect of the invention, a method for making a cleaning blade is described and includes the steps of (a) forming a blade sheet member having a uniform thickness T such that $\pm 4\%$ T is equal to $\pm$ M mils, (b) cutting a sharp cleaning edge at a first end of the sheet member such that the cleaning edge has a length L inches, (c) identifying a blade mounting line on the sheet member along points spaced W inches from the first end such that the stiffness per unit length L of the cleaning blades, when mounted along such line, is given by $(E/4)\ (T/W)^3$ and is within the range 0.5 lb./in.$^2$ to 2.5 lb./in.$^2$, and (d) cutting the sheet member at a second and opposite end that is spaced further from the first end than is the identified mounting line thereon.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
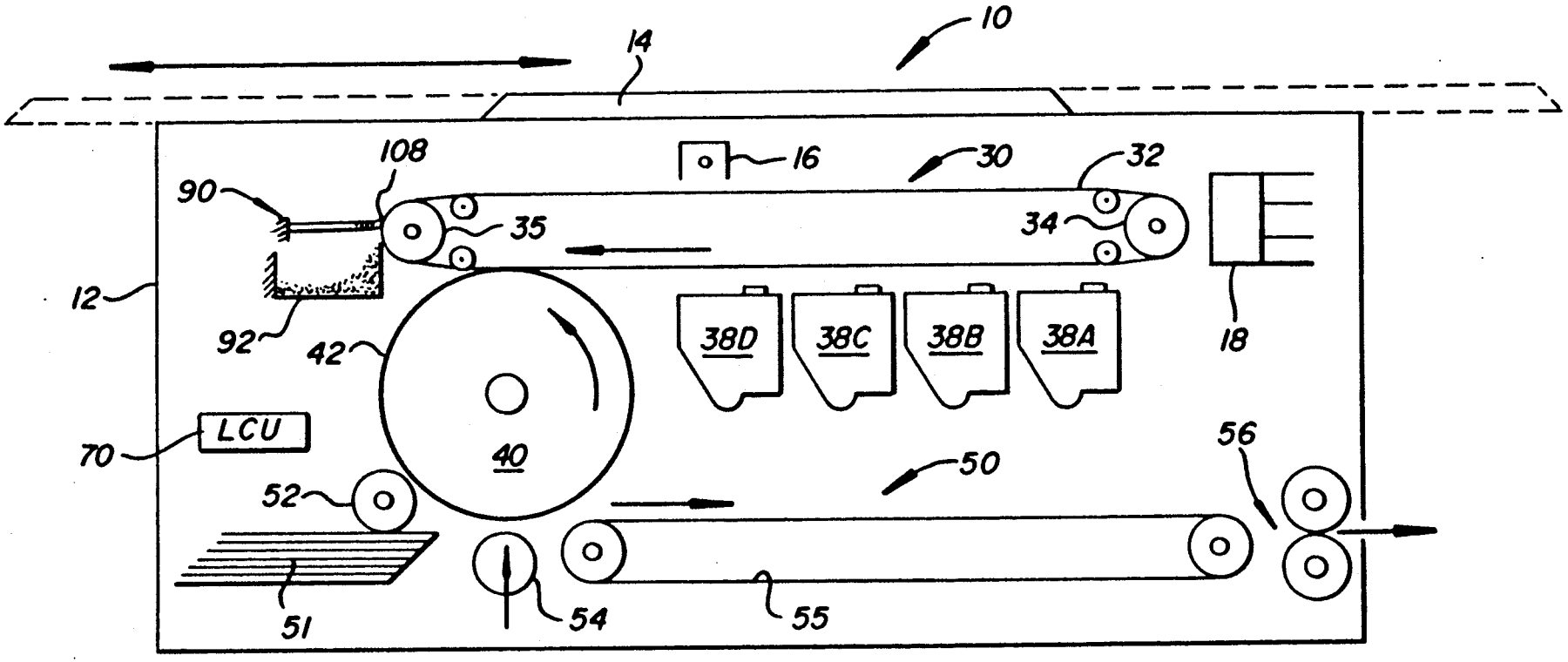
FIG. 1 is a schematic of an electrostatographic copier or printer embodying the cleaning apparatus of the present invention.

Referring now to FIG. 1 of the drawings, an electrostatographic apparatus such as a copier or printer is designated generally as 10. The apparatus 10, as shown, includes a housing 12, a document handling platen 14, a primary charger 16 and, for example, an electronic printhead 18. The apparatus 10 also includes an image-bearing member such as a photoconductor 30 with an image-bearing surface 32, four development stations 38A, 38B, 38C and 38D, an image transfer-related member 40 with an image-receiving surface 42, a copy sheet handling system 50, and a logic and control unit 70. The image-bearing surface 32 is cleaned, for example, by the cleaning apparatus of the present invention denoted generally as 90.

The photoconductor 30 as shown is a wide flexible endless web trained about rollers 34, 35. It is divided, for example, into a number of image frames and thus is capable of holding a plurality of different images at a time on its surface 32. On the other hand, the image transfer-related member 40, as illustrated, may be only as large circumferentially as one such image frame. Both the photoconductor 30 and the member 40 are normally electrically biased, thereby creating an electrical field that enhances toner particle transfer from the surface 32 of the photoconductor 30 onto the surface 42 of the member 40. Images transferred thus to the member 40 are then transferred from the member 40 to a copy sheet shown as 51.

The copy sheet 51 may be fed from a stack of such sheets by a roller 52. The fed sheet is then urged into registered contact with the member 40, for example, by a roller 54. After receiving the image from the member 40, the copy sheet 51 is thereafter moved by a sheet transfer system shown as 55 to a fusing station 56 where the image is fused onto the sheet.

After initial image transfer from a portion of the photoconductor 30 to the member 40, that particular portion of the photoconductor 30 continues to move on downstream where it is then cleaned by the cleaning apparatus 90 of the present invention. As shown, the cleaning apparatus 90 includes a reservoir 92 for collecting the waste particles removed by the apparatus 90, and is located downstream of the nip formed by the photoconductor 30 and the transfer member 40.

Figure 2A:
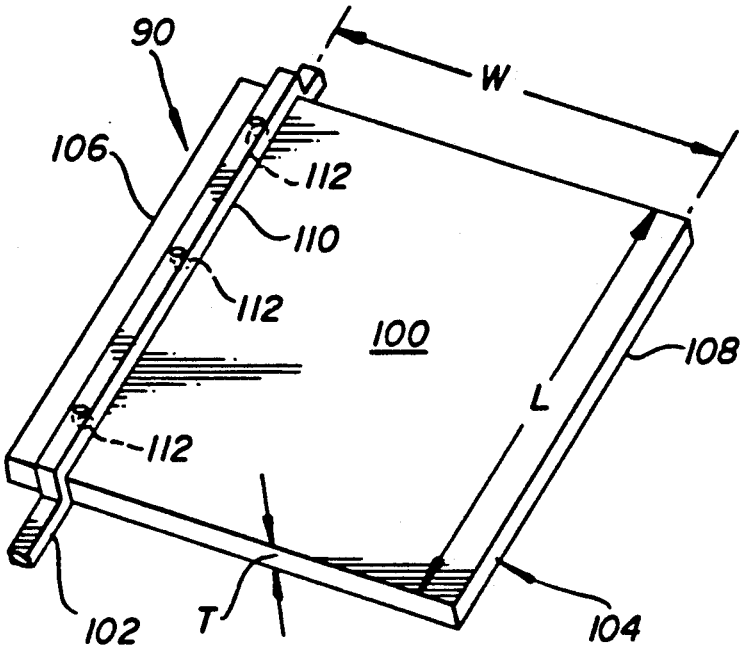
FIGS. 2A and 2B are each a perspective view of a cleaning blade of the present invention.
Figure 2B:
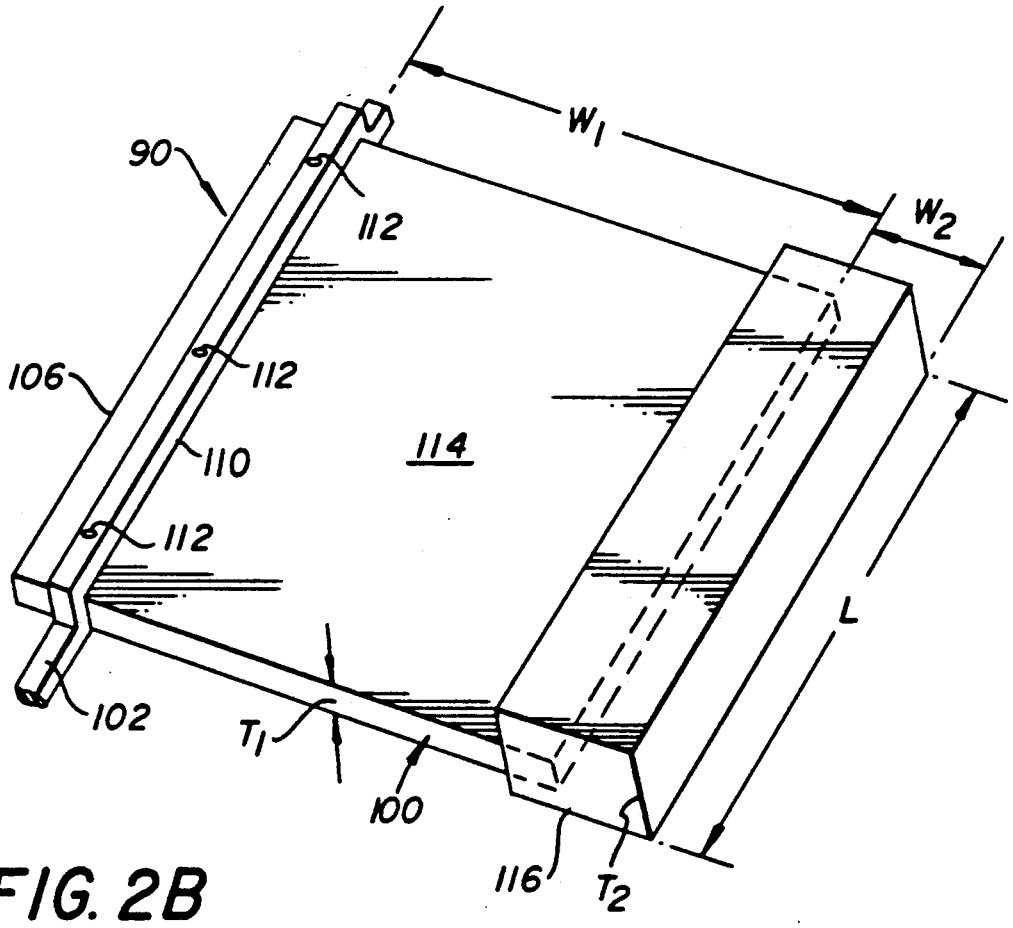

Referring now to FIGS. 2A and 2B, the cleaning apparatus 90 of the present invention is shown and comprises a cleaning blade 100 and a blade carrier member 102 for mounting the blade in a cantilevered manner as shown. The blade 100 preferably has a generally rectangular shape, and can be made entirely of a single material such as polyurethane or similar material (FIG. 2A) or of composite materials (FIG. 2B). The particular materials selected, however, have to possess high wear resistance and high resiliency properties so as to remain elastic even under changing temperature and humidity conditions. Typically, the material selected for the cleaning edge should have a hardness which is less than that of the surface being cleaned. As illustrated, FIGS. 2A, 2B, the blade 100 has a first end 104 and a second and opposite end 106. The first end 104 includes a sharp cleaning edge 108 which has a cleaning length shown as L units, for example inches, usually determined by the span of the surface being cleaned. When the blade 100 is mounted for cleaning a surface, such as the surface 32 (FIG 1), the cleaning edge 108 is loaded against such surface so as to have a predetermined and desired load force per unit length, and to deflect and effectively seal against such surface without damaging the surface. The blade 100 can be mounted, as such, in order to function as a scraping blade or as a wiping blade against the surface being cleaned.

In order for such cleaning to be effective, the edge 108 must seal in a substantially precise manner against the surface 32. Such a precise sealing must be achieved without excessive loading, and despite spatial variabilities, for example, in the straightness of the edge itself or in that of the surface 32. Furthermore, in order for the edge 108 not to inadvertently damage the surface 32, for example, the edge 108 must also remain loaded in a substantially precise manner about its predetermined nominal load per unit length value, across the entire cleaning length L. Substantial variation about such a predetermined nominal value must be avoided.

For example, in cleaning an image-bearing surface in an electrostatographic apparatus such as a copier or printer without damaging such surface, it is usually safe and desirable to load the edge 108 vertically at a predetermined nominal value selected from the range 0.1 lb./in. to 0.2 lb./in. As stated above, it has been found that, depending on the stiffness of the blade, and on its dimensional tolerances, a spatial variability of only $\pm 0.003''$ between the edge 108 and the surface 32 over the roller 35, such as caused by runout or eccentricity of the roller, anywhere across its length L, can result in a loading variation of about 60% over the desired nominal value selected from within this supposedly safe and desirable loading range. The stiffness of such a blade, of course, depends on the Young's modulus E of the material with which the blade is made and, as shown in FIGS. 2A, 2B, on the ratio between the thickness T and the free extension or width W thereof. The width W is measured from a line 110 at which it is mounted cantileveredly to the first end 104. As such, the mounting line 110 is located between the first end 104 and the second end 106, and is identified appropriately, for example, by the formation thereat of mounting holes 112.

According to the present invention, for effectively and safely cleaning an electrostatographic image-bearing surface, the thickness T and width W of the blade 100, made from a material having a Young's modulus E, should be selected such that its stiffness per unit length L of the cleaning edge 108 is within the range of 0.5 lb./in.$^2$ to 2.5 lb./in.$^2$. For example, the stiffness per unit length should equal a desired nominal value of approximately 1.5 lb./in.$^2$. Given the equations for the stiffness and moment of inertia of such a blade when mounted, as the stiffness equaling ($3EI/W^3$), and the moment of inertia I equaling ($LT^3/12$) (where L is the length of the cleaning edge) the stiffness in terms of thickness T and width W can be expressed as $(E/4)(T/W)^3$ (where (T/W) is the thickness-to-width ratio of the blade 100) for the purpose of determining T and W. Stiffness per unit length values lower and higher than the 1.5 lb./in.$^2$ can also be selected from a range of 0.5 lb./in.$^2$ to 2.5 lb./in.$^2$. The selected value is then set equal to the formula above, and appropriate values for T and W determined to fit, for example, the space available within the apparatus 10 for cleaning. An exemplary thickness T may be 0.200±0.005" and a width W of 1.000±0.005".

Furthermore, in accordance with the present invention, the tolerance for the thickness T and that for width W should each be controlled so as to combine with the selected stiffness per unit length value to result in a blade that has no more than ±12% variation about such a selected stiffness value, even in the presence of a ±0.003" spatial misalignment somewhere across the length L of cleaning edge of the blade. Accordingly, a maximum tolerance of ±4% of nominal value for the smaller of the two dimensions T, W is most effective in the above combination. Since the smaller dimension usually is the thickness T, the tolerance for T should therefore be set to less than or equal to ±4% of T determined as above. Optimally, the tolerance for the width W should also be made as tight as that for the thickness T, and hence equal to ±4% of W. However, since W is usually much larger than T, the ±4% of W in manufacturing is easier to attain than that of T, and thus in many instances an even tighter tolerance for W can be specified.

The ±4% T or less tolerance limit for the thickness T is very important. Therefore, both the particular nominal value for T, as well as the tight tolerance limit of the means or apparatus for manufacturing the blade, should be picked so as to stay within this limit. This is important because T usually is only a small fraction of an inch, and because the tightest tolerance capability, for example, of a blade manufacturing apparatus are usually stated independently of the particular blade to be made. Accordingly, a method of the present invention for using a blade manufacturing apparatus which has a tightest tolerance capability of M mils to make a cleaning blade that loads and seals in a substantially precise manner, should include the following steps. The first step should be to form a blade sheet member which has a thickness T from a desirable resilient material that has a Young's modulus E. The thickness T of the sheet member should be formed, for example, by extrusion such that the tightest tolerance limit M mils is equal to, or is at most ±4% of such thickness T. In other words, ±4% T should equal ±M mils. The next step is to cut a sharp cleaning blade edge 108 with squared edges, for example, at a first end 104 such that the edge 108 has a length L.

Given the Young's modulus E and appropriate thickness T for the blade 100 (FIG. 2A), a nominal value for the stiffness per unit length L, for example, a nominal value of 1.5 lb./in.$^2$, should then be selected. A mounting line shown as 110 should then be appropriately identified along points spaced W inches from the first end 104. The W inches, as such, represent the width or free extension of the resulting cleaning blade as measured from the first end 104 to points along the identified mounting line 110. The mounting line 110 should be so identified or established such that the resulting stiffness per unit length L, given by the formula $(E/4)(T/W)^3$ is equal approximately to the selected nominal value, for example, of 1.5 lb./in.$^2$. A second end 106, which is opposite from the first end 104 and is spaced therefrom so as to be further than the mounting line 110, should then be cut in the sheet member in order to form a blade 100.

Referring now to FIG. 2B, wherein like numbers refer to parts similar to those shown in FIG. 2A, a blade 100 of the present invention can be made from a plurality of materials, for example, including a backbone or support portion 114 made from a first material, such as metal, and a cleaning tip portion 116 as shown made from a second and usually softer material such as a polyurethane. The width $W_1$ of the backbone 114 is usually substantially greater than the width $W_2$ of the cleaning tip portion 116. According to the present invention, the same concepts, requirements and tolerances for the thickness T and width W of the blade of FIG. 2A apply to the blade FIG. 2B. Accordingly, manufacturing apparatus with a tightest tolerance capability of M mils should be selected given desirable values of $T_1$, $T_2$ and $W_1$, $W_2$ such that the tolerance limits of ±4% of such nominal values are achieved. The desirable values for $T_1$, $T_2$, $W_1$, W should also be determined such that the effect of the thickness $T_2$ and width $W_2$ of the cleaning tip do not significantly affect the loading and sealing of the blade, or such that the weighted values for the stiffness per unit length of the blade of FIG. 2B is equal to a desirable nominal value selected from within the range of 0.5 lb./in.$^2$ to 2.5 lb./in.$^2$.

A cleaning blade made according to the teachings of the present invention has been found to seal and load in a substantially precise manner against a surface to be cleaned. It does so by minimizing variations in the stiffness per unit length of the cleaning edge which may be due to spatial misalignments or to unacceptable tolerances, for example, in the thickness T and width W of the blade. The method for producing the blade is relatively inexpensive. According to this method, the thickness T of the blade can be established easily simply by using the tightest tolerance capability M mils of a blade manufacturing means to equal ±4% of T. Given the Young's modulus E of the material being used particularly to form the backbone or support portion of the blade, a stiffness per unit length value for the blade should then be selected from the range 0.5 lb./in.$^2$ to 2.5 lb./in.$^2$. A mounting line, and appropriate ends to the blade should then be cut such that its width W inches, as measured from its cleaning edge at one end to the mounting line, satisfies the equation in which the selected stiffness per unit length value is equal to $(E/4)(T/W)^3$.

The blade material which engages the film is usually polyester or polyether polyurethane elastomer having low compression set, high rebound resiliency, and high tear strength. These materials usually have a durometer of 50 to 90 Shore A and the blade is fabricated in such a way as to generate a sharp edge with radius of less than 10 microns. These materials usually require some type of lubrication at installation to reduce the start up drag torque. While the above material behaves mostly in a viscoelastic manner, one may determine experimentally an "elastic modulus, E", around the region of load application and use this value for the design selection. In the case of a composite blade having a metallic stiffener such as steel, beryllium copper, etc., the design is dictated by the dimensions of the metal due to its much higher elastic modulus.

The invention has been described in detail with particular reference to a presently preferred embodiment, but it will be understood that variations and modifications can be effected within the spirit and scope of the invention.

What is claimed is:

1. An electrostatographic cleaning blade that loads and seals in a substantially precise manner against a surface being cleaned, the blade being generally rectangular and made of a resilient material having a Young's modulus E, the cleaning blade having:

(a) a first end and an opposite second end;

(b) a thickness T;

(c) a sharp cleaning edge at said first end having a length L inches;

(d) means for mounting said blade, said mounting means defining a mounting line located between said first end and said second end for cantileveringly mounting said blade thereat;

(e) a width W inches of said blade extending from said first end to said mounting line; and (f) a stiffness per unit length nominal value of $(E/4)(T/W)^3$ within the range of 0.5 lb./in.$^2$ to 2.5 lb./in.$^2$.

2. The cleaning blade of claim 1 wherein the thickness T varies in said blade by ±4% T or less.

3. The cleaning blade of claim 1 wherein said thickness T has a tolerance of ±4% T.

4. The cleaning blade of claim 1 wherein said width W inches varies along the length of the blade by ±4% W or less.

5. The cleaning blade of claim 1 wherein the stiffness per unit length value of said blade is approximately 1.5 lb./in.$^2$.

6. The cleaning blade of claim 2 wherein said stiffness per unit length value varies by less than ±12% of nominal value across said cleaning length L of said blade.

7. A method using means having a tightest tolerance capability of M mils for making a cleaning blade for precise loading and sealing against a surface being cleaned, the cleaning blade being formed from a resilient material having a Young's modulus E, the method including the steps of:

(a) forming a blade sheet member having a uniform thickness T inches such that ±4% T is equal to ± M mils;

(b) cutting a sharp cleaning blade edge at a first end of said sheet member such that said cleaning edge has a length L inches;

(c) identifying a blade mounting line on said sheet member along points spaced W inches from said first end such that the stiffness per unit length L of the cleaning blade, when mounted along said mounting line, given by $(E/4)(T/W)^3$, is within the range 0.5 lb./in.$^2$ to 2.5 lb./in.$^2$; and (d) cutting said sheet member at a second and opposite end that is spaced further from said first end than is said identified mounting line thereon.

* * * * *